United States Patent [19]

Bushman

[11] 4,334,939

[45] Jun. 15, 1982

[54] TL-78 EXPLOSIVE COMPOSITION

[75] Inventor: Ted E. Bushman, Granger, Utah

[73] Assignee: International Minerals & Chemical Corp., Terre Haute, Ind.

[21] Appl. No.: 210,456

[22] Filed: Nov. 25, 1980

[51] Int. Cl.[3] ..... C06B 45/02

[52] U.S. Cl. ..... 149/21; 149/47; 149/38; 149/43; 149/89; 149/112; 149/114

[58] Field of Search ..... 149/21, 47, 89, 38, 149/43, 112, 114

[56] References Cited

U.S. PATENT DOCUMENTS

| | | | |
|---|---|---|---|
| 3,356,544 | 12/1967 | Fee et al. | 149/89 X |
| 3,366,053 | 1/1968 | Griffith et al. | 149/43 X |
| 4,263,068 | 4/1981 | Edwards et al. | 149/2 |

*Primary Examiner*—Stephen J. Lechert, Jr.
*Attorney, Agent, or Firm*—Robert H. Dewey

[57] ABSTRACT

An explosive composition comprising ammonium nitrate, a nitroalkane, a sensitizer, and an oxidizable fuel.

7 Claims, No Drawings

TL-78 EXPLOSIVE COMPOSITION

BACKGROUND OF THE INVENTION

This invention relates to an improved explosive composition. In a particular aspect this invention relates to an explosive composition characterized by good sensitivity.

It is frequently desirable during blasting operations to merely fracture a formation without causing massive destruction. This can best be effected by means of small diameter but relatively long explosive charges. Such charges must be characterized by good propagation so that all of the charge detonates. Residual, undetonated charge not only fails to accomplish the intended result, it also poses a hazard in succeeding operations because it may detonate untimely. Also, advantageously the composition should have a high density so that it will sink in wet bore holes, i.e. holes having an appreciable water level.

SUMMARY OF THE INVENTION

It is an object of this invention to provide an improved explosive composition.

It is another object of this invention to provide an improved explosive composition having a high density with good sensitivity.

Other objects of this invention will be apparent to those skilled in the art from the description herein.

It is the discovery of this invention to provide an improved explosive composition comprising ammonium nitrate, nitropropane, a sensitizer and an oxidizable fuel. The composition has good sensitivity and propagates well. It is especially well-adapted for use in small diameter holes, i.e. 2 inches in diameter or less.

DETAILED DESCRIPTION

The composition of this invention comprises ammonium nitrate in an amount of about 83–91% by weight mixed with about 1–9% by weight of nitropropane, about 1–4% of a sensitizer, and about 1 to 4% of an oxidizable fuel.

The nitropropane used in preparing the composition of this invention is either 1 -nitropropane or 2-nitropropane or a mixture thereof; both are commercially available.

The ammonium nitrate preferred for the practice of this invention is preferably high density, explosive grade ammonium nitrate prills, as known in the art. The ammonium nitrate is comminuted, e.g., in a hammer mill having a 1/16 inch screen on the discharge side. Following is a typical U.S. Standard Screen analysis of such comminuted ammonium nitrate:

| | |
|---|---|
| +18 | 0–5% |
| +35 | 20–30% |
| +60 | 30–35% |
| +80 | 10–15% |
| +120 | 10–15% |
| +230 | 10–20% |
| −230 | 0–5% |

The oxidizable fuel used in the practice of this invention is comminuted coal, preferably anthracite. If bituminous coal is used, it is preferably of low sulfur content. It should be sufficiently fine to pass a 20-mesh sieve.

The sensitizer used in the practice of this invention is commercially available flake aluminum. Preferably it is the type useful in the preparation of lacquers and enamels in the coatings industry. The amount used is rather critical. Above 4% and below 1% of flake aluminum, the mixture loses sensitivity. The preferred amount is 3%.

The composition of this invention is readily prepared by mixing the nitropropane and ammonium nitrate, then adding the aluminum and coal. Mixing is continued for a few minutes in a conventional manner and the mixture is then discharged into suitable containers, e.g. plastic bags.

The composition is especially useful in small diameter bore holes of ¾ inch or more. It is heavier than water, so if water collects in the bore hole, the blasting agent sinks without difficulty. It can be detonated by an electric blasting cap, usually a No. 2 or 3, depending somewhat on the fineness of grind of the ammonium nitrate (i.e. the density of the mix). The composition has a detonation rate of about 3811 meters/second and propagates well. Following is a preferred composition:

| | |
|---|---|
| Ammonium nitrate | 88.0% |
| Nitropropane | 6.0% |
| Coal, ground | 3.0% |
| Flake aluminum | 3.0% |
| | 100% |

It is an embodiment of this invention to provide a finished, packaged blasting agent comprising the blasting agent described hereinbefore packaged in a laminated nylon bag up to 2 inches in diameter. The nylon is at least 1.25 mil thickness, there being no upper limit as to thickness. However, 1 mil thickness nylon film is relatively easily torn and punctured and because heavier gauge nylon is relatively expensive, it is preferred to employ the nylon bag in conjunction with polyethylene, such as Plexar. The nylon can be laminated to the polyethylene or it can merely be formed into a bag, heat-sealed at one end and inserted in a polyethylene bag, also heat sealed at one end. Such a packaging system wherein the nylon is of from 1 to 2 mil and the polyethylene is from 4–5 mil has proven very successful. A laminated bag wherein the nylon is sandwiched between two layers of polyethylene is preferred.

Nylon is the only film so far discovered which will contain nitroalkanes for a satisfactory shelf-life period. All others tested have apertures and voids, which, though microscopic, are sufficient to permit the nitroalkane to evaporate and the composition thereby becomes insensitive and useless.

The invention will be better understood with reference to the following examples. It is understood, however, that the examples are intended only to illustrate the invention, and it is not intended that the invention be limited thereby.

EXAMPLE 1

A sample of explosive grade, uncoated, high density prilled ammonium nitrate was ground through a hammer mill having 1/16 inch screen at the discharge side. The comminuted material was mixed with 1-nitropropane. Then powdered anthracite coal, sufficiently fine to pass a 20 mesh screen, and aluminum flake were added. The aluminum flake was obtained from Reynolds Aluminum Company. It was identified as AL 536, a paint grade flake coated with Corvus oil. The composition was as follows:

| | |
|---|---|
| Ammonium nitrate | 89.0% |
| 1-Nitroropane | 6.0% |
| Aluminum | 2.0% |
| Coal | 3.0% |

It had the following properties:

| | |
|---|---|
| Standard density | 1.28 |
| Pack density | 1.18 |
| Detonation sensitivity, Atlas Cap No. | 2 |
| Detonation rate | 3811 m/sec |
| Gap | 7 cm |

There was no effect in the standard pendulum friction test using a steel shoe and it was classified non-burning from the results of the 1-inch burning-explosion test. It propagated completely in a 2-inch seismic tube of 100 cm (39.4 in) in length.

EXAMPLE 2

The experiment of Example 1 is repeated in all essential details except that 2-nitropropane (2-NP) is substituted for 1-NP. The resulting mixture is satisfactory in all respects.

EXAMPLE 3

The experiment of Example 1 was repeated in all essential details using the following formula:

| | |
|---|---|
| Ammonium nitrate | 88.0% |
| 1-Nitropropane | 6.0% |
| Coal | 3.0% |
| Aluminum flake | 3.0% |

The mixture was packed into $1\frac{1}{8}$ inch spiral wound shell. The sensitivity was in the range of #1 to #3 cap. The detonation rate was approximately 3300 m/sec. It propagated completely.

EXAMPLE 4

The experiment of Example 1 was repeated in all essential details using the following formula:

| | |
|---|---|
| Ammonium nitrate | 91.0% |
| 1-Nitropropane | 5.0% |
| Aluminum | 2.0% |
| Coal | 2.0% |

The properties were:

| | |
|---|---|
| Standard density | 1.275 |
| Pack density | 1.19 |
| Detonation sensitivity, Atlas Cap No. | 1 |
| Detonation rate | 3217 m/sec |
| Gap | 5 cm |

It propagated completely in a 2 inch×48 inch seismic tube.

I claim:

1. An explosive composition suitable for small diameter bore holes consisting of comminuted ammonium nitrate 83–91% by weight, nitropropane 1–9%, flake aluminum sensitizer 1∝4%, comminuted coal 1–4%.

2. The composition of claim 1 wherein the ammonium nitrate passes a 16 mesh sieve.

3. The composition of claim 1 wherein the ammonium nitrate is present in an amount of about 88%.

4. The composition of claim 1 wherein the coal passes a 20 mesh screen.

5. The composition of claim 1 wherein the nitropropane is 1-nitropropane.

6. The composition of claim 1 wherein the nitropropane is 2-nitropropane.

7. The composition consisting of comminuted ammonium nitrate 88% by weight, nitropropane 6%, aluminum flake 3%, and comminuted coal 3%.

* * * * *

UNITED STATES PATENT AND TRADEMARK OFFICE

CERTIFICATE OF CORRECTION

PATENT NO. : 4,334,939

DATED : June 15, 1982

INVENTOR(S) : Ted E. Bushman

It is certified that error appears in the above-identified patent and that said Letters Patent are hereby corrected as shown below:

Claim 1, line 4, "1∝4%" should read -- 1-4% --

Signed and Sealed this

*Twenty-fourth* Day of *August 1982*

[SEAL]

*Attest:*

GERALD J. MOSSINGHOFF

*Attesting Officer*

*Commissioner of Patents and Trademarks*